United States Patent [19]

Yagi et al.

[11] Patent Number: 4,798,775

[45] Date of Patent: Jan. 17, 1989

[54] PROCESS FOR PRODUCING SILVER HALIDE PHOTOGRAPHIC EMULSION

[75] Inventors: Toshihiko Yagi, Kanagawa; Shinya Shimura, Hachioji, both of Japan

[73] Assignee: Konishiroku Photo Industry Co., Ltd., Tokyo, Japan

[21] Appl. No.: 11,363

[22] Filed: Feb. 2, 1987

Related U.S. Application Data

[63] Continuation of Ser. No. 744,472, Jun. 13, 1985, abandoned.

[30] Foreign Application Priority Data

Jun. 20, 1984 [JP] Japan ..... 59-127189

[51] Int. Cl.[4] ..... G03C 1/02

[52] U.S. Cl. ..... 430/569; 430/567

[58] Field of Search ..... 430/569, 567

[56] References Cited

U.S. PATENT DOCUMENTS 4,067,739 1/1978 Lewis ..... 430/569
4,301,241 11/1981 Saito ..... 430/569
4,434,226 2/1984 Wilgus et al. ..... 430/569

FOREIGN PATENT DOCUMENTS 209730 12/1983 Japan .
211143 12/1983 Japan .

*Primary Examiner*—Won H. Louie
*Attorney, Agent, or Firm*—Jordan B. Bierman

[57] ABSTRACT

A process for producing a silver halide photographic emulsion by supplying a solution of a water-soluble silver salt and a solution of a water-soluble halide in the presence of a protective colloid is disclosed, said process comprising, in sequence:

(A) the step of forming silver halide nuclear grains with a silver iodide content of 0 to 5 mol %, wherein the pH of the mother liquor is maintained at between 2.0 and −0.7 for at least the initial half of the period of said step;

(B) the step of forming silver halide seed grains wherein the silver halide grains formed by step (A) above are made into monodisperse, substantially spherical seed grains; and (C) the step of increasing the sizes of the seed grains by addition of a solution of a water-soluble silver salt and a solution of a water-soluble halide and/or fine silver halide grains.

5 Claims, No Drawings

PROCESS FOR PRODUCING SILVER HALIDE PHOTOGRAPHIC EMULSION

This application is a continuation, of application Ser. No. 744,472, filed June 13, 1985, abandoned.

BACKGROUND OF THE INVENTION

The present invention relates to a silver halide emulsion suitable for incorporation in a silver halide photographic material. More particularly, the invention relates to a process for producing a silver halide photographic emulsion comprising monodisperse twinned grains.

With the recent tendency to use color negative films with high sensitivity and in a small format, the demand for silver halide photographic materials capable of producing images of high quality is becoming more stringent than before. With a view to improving the granularity of monodisperse, normal crystalline silver halide grains in emulsions, many approaches have been proposed for controlling the grain size, size distribution, the halide composition within the grains, and their crystalline structures. On the other hand, polydisperse silver iodobromide twinned grains are conventionally used to prepare emulsions adapted to high-sensitivity photographic films. The exact reason why emulsions comprising twinned crystals provide a higher sensitivity is not clear but the primary reason would be that twinned crystals have a propensity to grow to large sizes. Additionally, the twinning planes within silver halide grains are considered to play an important role during the photographic process.

While twinned crystals have advantageous photographic properties and are extensively used in emulsions, the mechanism of their formation has not been fully unravelled and no technique has been established that is capable of satisfactory control over their growth.

Japanese patent publication No. 58-36762 and Unexamined Published Japanese patent application No. 52-153428 proposed techniques for controlling the growth of monodisperse twinned crystals so that they acquire advantageous photographic properties, but the obtained twinned crystals do not have a completely satisfactory level of monodispersity. Unexamined Published Japanese patent application Nos. 55-142329, 58-211143 and 58-209730 disclose growth methods for monodisperse silver halide crystals, but the emulsions obtained by these methods have such a small fraction of twinned crystals that they can hardly be described as emulsions comprising monodisperse twinned grains.

It has been predicted theoretically that by narrowing the size distribution of the grains in a silver halide emulsion, the efficiency of grain utilization is increased (i.e., "dead grains" are decreased) and a higher sensitivity and better granularity are provided. However, no emulsion has ever been prepared that comprises satisfactorily monodisperse twinned crystals.

SUMMARY OF THE INVENTION

One object, therefore, of the present invention is to provide a process for producing a photographic emulsion that has a minimum proportion of dead grains and which achieves improved sensitivity and granularity.

Another object of the present invention is to provide a process for producing an emulsion comprising monodisperse twinned crystalline grains.

A further object of the present invention is to provide a method of forming seed crystals suitable for producing an emulsion comprising monodisperse twinned grains.

These objects of the present invention can be achieved by a process for producing a silver halide photographic emulsion by supplying a solution of a water-soluble silver salt and a solution of a water-soluble halide in the presence of a protective colloid, said processes comprising, in sequence:

(A) the step of forming silver halide nuclear grains with a silver iodide content of 0 to 5 mol %, wherein the pH of the mother liquor is maintained at between 2.0 and −0.7 for at least the initial half of the period of said step;

(B) the step of forming silver halide seed grains wherein the silver halide grains formed by Step A above are made into monodisperse, substantially spherical seed grains; and (C) the step of increasing the sizes of the seed grains by addition of a solution of a water-soluble silver salt and a solution of a water-soluble halide and/or fine silver halide grains.

DETAILED DESCRIPTION OF THE INVENTION

The term "mother liquor" as used herein means a silver halide emulsion that is subjected to the procedures for providing a complete photographic emulsion.

The silver halide nuclei that are formed in the nucleation stage (A) are preferably twinned crystals composed of silver iodobromide containing 0–5 mol % of silver iodide.

"Twinned crystal" means a silver halide crystal having at least two twinning planes within a single grain. Detailed morphological classifications of twinned crystals are found in E. Klein and E. Moisar, Photgr. Korresp., 99, 99 and 100, 57. The twinning planes in a single crystal may or may not be parallel to each other. The twinned crystal may be bound by (111) surfaces, (100) surfaces or by both surfaces.

In accordance with the present invention, silver halide nuclei are formed by adding a water-soluble silver salt either independently or in combination with a water-soluble halide while the concentration of bromide ions in the aqueous solution of a protective colloid is held at 0.01–5 moles/L (pBr=2.0 to −0.7), preferably 0.03–5 moles/L (pBr=1.5 to −0.7) for at least the initial half of the period of nucleation.

The nucleation stage in the process of the present invention principally covers the period that starts with the addition of the water-soluble silver salt to the solution of protective colloid and ends when this solution has become substantially free of further formation of nuclei. However, the nucleation stage as used in the present invention may include the subsequent period of nuclear growth and therefore can be defined as any step that precedes the formation of seed grains. There is no particular limitation on the size distribution of the nuclei formed in accordance with the present invention and they may be either monodisperse or polydisperse. Polydispersity may be defined as grains having a coefficient of variation of 25% or more. The fraction of twinned crystals present in the nuclei in accordance with the present invention is preferably at least 50% of the total number of the nuclei. A fraction of at least 70% is more preferred and most preferably, all nuclei are composed of twinned crystals.

The most important aspect of the process of the present invention is the step of forming seed grains comprising monodisperse spheres by ripening the nuclei in the presence of a silver halide solvent. The ripening in the presence of a silver halide solvent (hereinafter simply referred to as ripening) is believed to differ from Ostwalt ripening which is generally considered to produce grains of a broad size distribution as a result of growth of large particles in preference over coexisting small particles. The present inventors studied the conditions for ripening seed grains from the nuclei and have found that substantially monodisperse, spherical seed grains can be formed by incorporating $10^{-4}-2.0$ moles per mole of silver halide of a silver halide solvent in mother liquor that has been subjected to the nucleation step for producing twinned nuclei from silver halide with a silver iodide fraction of 0–5 mol %.

The present inventors deposited fresh silver halide on the surfaces of the thus obtained seed grains and successfully prepared an emulsion consisting predominantly of substantially monodisperse twinned crystalline grains that could not previously be obtained under low pBr conditions.

The term "substantially monodisperse" means that the grains in question have a coefficient of variation of less than 25%, the coefficient of variation being expressed by $S/\bar{r}\times 100$, wherein S is the standard deviation of the size distribution of the grains and $\bar{r}$ is the average grain size.

The term "substantially spherical" means that 1) the silver halide grains of interest are so nearly close to a sphere in shape that their (111) planes are hardly distinguishable from their (100) faces when viewed under an electron microscope and that 2) when three planes are assumed that intersect at a point very close to the center of gravity of a grain, $C=L/l$ of the projected image of that grain is 1.0–2.0, preferably 1.0–1.5, L being a maximum diameter in x, y or z direction and l being a minimum diameter.

In accordance with the present invention, such spherical grains should account for at least 60%, preferably at least 80%, of the total number of the grains concerned. More preferably, almost all of the grains should be spherical.

Examples of the silver halide solvent that can be used in the step of forming seed grains are listed below: (a) organic thioethers as described in U.S. Pat. Nos. 3,271,157, 3,531,289, 3,574,628, Unexamined Published Japanese patent application Nos. 54-1019, 54-158917 and Japanese patent publication No. 58-30571; (b) thiourea derivatives as described in Unexamined Published Japanese patent application Nos. 53-82408, 55-77737 and 55-29829; (c) AgX solvents having a thiocarbonyl group bonded between an oxygen or sulfur atom and a nitrogen atom either directly or indirectly as shown in Unexamined Published Japanese patent application No. 53-144319; (d) imidazoles as shown in Unexamined Published Japanese patent application No. 54-100717; (e) sulfite salts; (f) thiocyanates; (g) ammonia; (h) hydroxylakyl substituted ethylenediamines as shown in Unexamined Published Japanese patent application No. 57-196228; (f) substituted mercaptotetrazoles as shown in Unexamined Published Japanese patent application No. 57-202531; (j) water-soluble bromides; and (k) benzimidazole derivatives as described in Unexamined Published Japanese patent application No. 58-54333.

Specific examples of these silver halide solvents (a) to (k) are listed below.

(a)

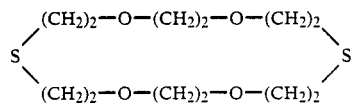

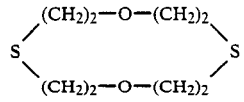

$HO-(CH_2)_2-S-(CH_2)_2-S-(CH_2)_2-OH$

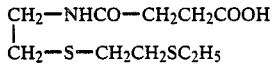

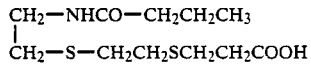

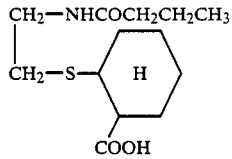

(b)

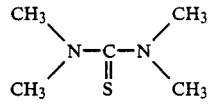

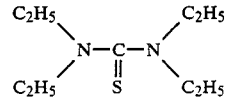

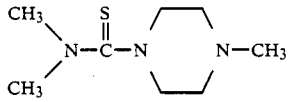

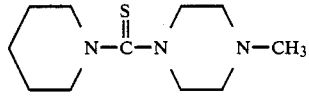

(c)

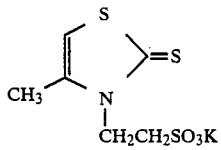

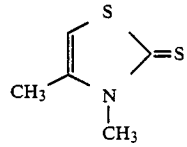

(d)

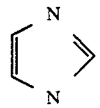

-continued

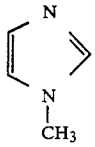

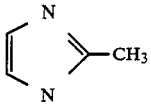

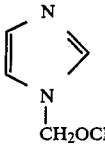

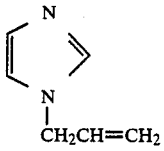

$K_2SO_3$ (e)

$NH_4SCN$, KSCN (f)

$NH_3$ (g)

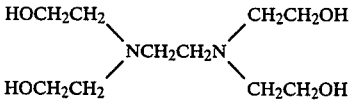

(h)

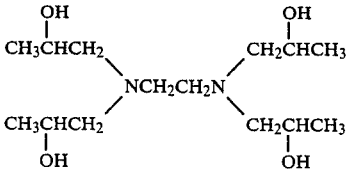

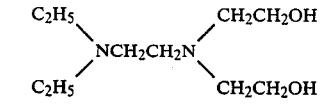

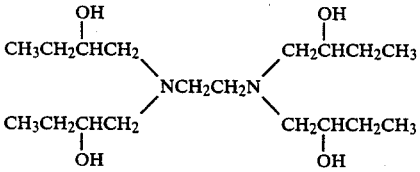

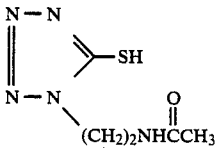

(i)

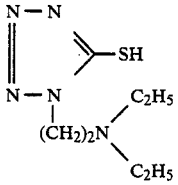

(i)

-continued

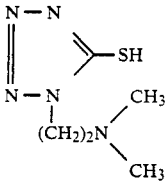

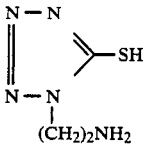

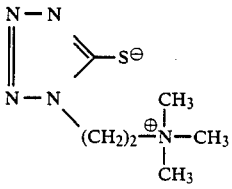

NaBr, $NH_4Br$, KBr (j)

(k)

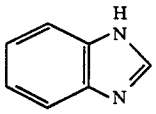

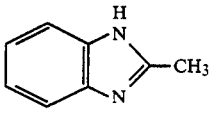

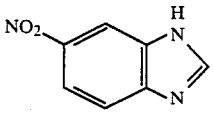

The solvents listed above may be used in combination with themselves. Preferred solvents are thioethers, thiocyanates, thioureas, ammonia and bromides, with the combinations of ammonia other solvents, particularly ammonia and bromides, being preferred.

These solvents are used preferably in amounts ranging from $1\times10^{-4}$ to 5 moles, more preferably from $1\times10^{-3}$ to 2 moles, per liter of the mother liquid.

The seed grains in accordance with the present invention are formed by ripening, preferably at a pH in the range of 4 to 12 and at a temperature in the range of 30 to 60° C., with the ranges of 6 to 12 and 35° to 50° C. being particularly preferred.

In a preferred embodiment, an emulsion containing the desired seed grains is obtained by ripening for a period of 30 seconds to 5 minutes at a pH between 10.8 and 11.2 and a temperature between 35° and 45° C. using a mixed solvent consisting of 0.4–1.0 mole/L of ammonia and 0.03–0.5 mole/L of potassium bromide.

The silver halide solvents to be used in the present invention may be incorporated into the emulsion in the form of an aqueous solution, but, according to need, may also be incorporated by being dissolved in an aqueous solution of either silver salt or halide.

A water-soluble silver salt may be added during the formation of seed grains for the purpose of controlling the ripening of the nuclei.

Subsequently, the formed silver halide seed grains are subjected to growing step (C) wherein their sizes are increased by controlling various factors involved in the precipitation of silver halide and Ostwalt ripening, such as pAg, pH, temperature, concentration of the silver halide solvent, the composition of the silver halide, as well as the rates of addition of silver salt and halide.

One method for increasing the sizes of the seed grains is described in Unexamined Published Japanese patent application Nos. 51-39027, 55-142329, 58-113928, 54-48521 and 58-49938: solutions of a water-soluble salt and a water-soluble halide are added by the double-jet method, with the addition rate being gradually changed as the grain size is increased on the condition that no further formation of nuclei and Ostwalt ripening will occur. Another method that can be used to increase the sizes of the seed grains is described on page 88 of the Proceedings of the Annual Meeting for 1983 of the Society of Photographic Science and Technology of Japan: after addition of fine silver halide grains, dissolution and recrystallization are performed to obtain fully grown seed grains. The first method is preferred for the purposes of the present invention.

For obtaining large seed grains, the concentration of halide ions is preferably at least $1\times10^{-3}$ mole/L, more preferably in the range of $1\times10^{-2}$ −2 moles/L. If the halide ion concentration is less than $1\times10^{-2}$ mole/L, monodisperse grains are obtained but they have an increased proportion of normal crystals. If the halide ion concentration is more than 2 moles/L, an emulsion comprising monodisperse grains is difficult to obtain.

In accordance with the process of the present invention, an emulsion is provided that comprises silver halide grains at least half of which in number are twinned crystals. Under optimum conditions, the fraction of twinned crystals can be increased to 80% or higher.

The silver halide suitable for use in the growing stage is sliver iodobromide, preferably with 0–40 mol % silver iodide, more preferably with 0–20 mol % silver iodide.

A sliver halide solvent may be present in the growing step for the purpose of accelerating the growth rate, and a suitable solvent may be selected from the list of compounds given in association with the step of forming seed grains.

If the silver halide grains prepared by the present invention are incorporated in an emulsion layer in light-sensitive materials, it is preferred that at least 30 wt % of such grains consists of the monodispherse twinned crystals obtained in accordance with the present invention. More preferably, at least 50 wt. % of such grains consists of the monodisperse twinned crystals.

The process of the present invention may be implemented in the presence of cadmium salts, zinc salts, lead salts, thallium salts, iridium salts or complex salts thereof, rhodium salts or complex salts, etc.

The silver halide emulsion prepared in accordance with the present invention may be spectrally sensitized with a variety of dyes. Usable sensitizing dyes are polymethine dyes including cyanine, merocyanine, complex cyanine, complex merocyanine (tri-, tetra- and polynuclear cyanines and merocyanine), oxonol, hemioxonol, styryl, merostyryl and streptocyanine dyes.

Illustrative cyanine dyes include those having two basic heterocyclic nuclei linked by a methine bond, such as those derived from quinolinium, pyridinium, isoquinolinium, 3H-indolium, benzindolium, oxazolium, oxazolinium, thiazolium, thiazolinium, imidazolinium, benzoxazolium, benzothiazolium, benzoselenazolium, benzimidazolium, naphtooxazolium, naphthothiazolium, naphthoselenazolium, thiazolinium, dihydronaphthothiazolium, pyrylium, and imidazopyrazinium quaternary salts.

Illustrative merocyanine dyes include those having an acidic nucleus coupled to a basic heterocyclic nucleus of the cyanine dye type, such as those derived from barbituric acid, 2-thiobarbituric acid, rhodanine, hydantoin, 2-thiohydantoin, 4-thiohydantoin, 2-pyrazolyl-5-one, 2-isooxazoline-5-one, indan-1,3-dione, 1,3-dioxane-4,6-dione pyrazoline-3,5-dione, pentane-2,4-dione, alkylsulfonylacetonitrile, malononitrile, isoquinoline-4-one and chroman-2,4-dione.

The spectral sensitizing dyes that may be advantageously used in sensitizing the silver halide emulsion in accordance with the present invention are described in British patent No. 742,112, as well as U.S. Pat. Nos. 1,846,300, 1,846,301, 1,846,302, 1,846,303, 1,846,304, 2,078,233, 2,089,729, 2,165,338, 2,213,238, 2,231,658, 2,493,747, 2,493,748, 2,526,632, 2,739,964, (reissued as No. 24,292), 2,778,823, 2,917,516, 3,352,857, 3,411,916, 3,431,111, 2,295,276, 2,481,698, 2,503,776, 2,688,545, 2,704,714, 2,921,067, 2,945,763, 3,282,933, 3,397,060, 3,660,102, 3,660,103, 3,335,010, 3,352,680, 3,384,486, 3,397,981, 3,482,978, 3,623,881, 3,718,470 and 4,025,349.

Examples of the useful dye combinations including supersensitizing dyes are shown in U.S. Pat. Nos. 3,506,443 and 3,672,898. Illustrative combinations for supersensitization that consist of spectral sensitizing dyes and non-light-absorbing compounds are as follows: a thiocyanate is used during spectral sensitization as shown in U.S. Pat. No. 2,221,805; bis-triazinylaminostilbene is used as shown in U.S. Pat. No. 2,933,390; a sulfonated aromatic compound is used as disclosed in U.S. Pat. No. 2,937,089; a mercapto sensitizing heterocyclic compound is used as shown in U.S. Pat. No. 3,457,087; an iodide is used as shown in British patent No. 1,413,826; and compounds of the type described in P. B. Gilman, "Review of the Mechanism of Supersensitization" are used. In addition to these compounds, many other known compounds may be used for the purpose of supersensitization. The sensitizing dyes may be added at any stage such as before, during or after the chemical ripening (also referred to as second ripening) of the silver halide emulsion. They may also be added at a suitable stage that precedes the coating of the emulsion onto a support.

The sensitizing dyes may be added to the photographic emulsion by a variety of known techniques. For example, as proposed in U.S. Pat. No. 3,469,987, the sensitizing dyes are dissolved in volatile organic solvents, the resulting solution is dispersed in a hydrophilic colloid, and the dispersion so obtained is added to the emulsion. The individual sensitizing dyes may be dissolved in the same solvent or different solvents, and in the latter case, the different solutions may be added to the emulsion either separately or after combining them into a single solution.

Preferred solvents in which the sensitizing dyes are dissolved before they are added to the silver halide emulsion are water-miscible organic solvents such as methyl alcohol, ethyl alcohol and acetone.

The sensitizing dyes are incorporated in the silver halide emulsion in amounts ranging from $1\times10^{-5}$ to $2.5\times10^{-2}$ mole, perferably $1.0\times10^{-4}$ to $1.0\times10^{-3}$ mole, per mole of the silver halide.

The silver halide grains prepared in accordance with the present invention may be chemically sensitized by a variety of compounds such as activated gelatin; noble metal sensitizers (e.g. water-soluble gold salts, water-soluble platinum salts, water-soluble palladium salts, water-soluble rhodium salts and water-soluble iridium salts); sulfur sensitizers; selenium sensitizers; and reduction sensitizers (e.g. polyamine and stannous chloride). Such sensitizers may be used alone or in combination with themselves.

Known sulfur sensitizers may be used, and they include thiosulfates, allylthiocarbamide thiourea, allylisothiacyanate, cystine,p-toluene thiosulfonate salt, and rhodanine. Also usable are the sulfur sensitizers described in U.S. Pat. Nos. 1,574,944, 2,410,689, 2,278,947, 2,728,668, 3,501,313, 3,656,955, German patent No. 1,422,869, Japanese patent No. 56-24937, and Unexamined Published Japanese patent application No. 55-45016. The sulfur sensitizers may be added in the amounts that are sufficient to effectively enhance the sensitivity of the emulsion. The necessary amounts may vary considerably depending upon various factors such as pH, temperature and the sizes of silver halide grains. As a guide, the sulfur sensitizers are preferably used in amounts ranging from ca. $10^{-7}$ to ca. $10^{-1}$ mole per mole of silver halide. The sulfur sensitizers may be replaced by selenium sensitizers such as alliphatic isoselenocyanates (e.g. allyl isoselenocyanate), selenoureas, selenoketones, selenoamides, selenocarboxylic acids and esters thereof, selenophosphates, and selenides (e.g. diethyl selenide). Specific examples of the selenium sensitizers are listed in U.S. Pat. Nos. 1,574,944, 1,602,592 and 1,623,499. The amounts of the selenium sensitizers added may vary over a wide range as in the case of the sulfur sensitizers, and as a guide figure, the range of ca. $10^{-7}-10^{-3}$ mole per mole of silver halide may be given.

A variety of gold compounds having the oxidation number of either 1 or 3 may be used as gold sensitizers in the present invention. Typical gold sensitizers include chloroauric acid salts (e.g. potassium chloroaurate), auric trichloride, potassium auric thiocyanate, potassium iodoaurate, tetracyanoauric acid, ammonium aurothiocyanate and pyridyl trichlorogold. The amounts of the gold sensitizers added may also vary with specific conditions, and as a guide figure, the range of ca. $10^{-7}$ to $10^{-1}$ mole per mole of silver halide may be given.

Other noble metals such as platinum, palladium, iridium and rhodium, as well as salts thereof may also be used for chemically sensitizing the silver halide grains prepared in accordance with the present invention.

There is no particular limitation on the reduction sensitizers that can be used in the present invention, and known reducing compounds such as stannous chloride, thiourea dioxide, hydrazine derivatives and silane compounds may be used. Reduction sensitization is preferably performed during the growth of silver halide grains or after completion of the sulfur reduction or gold reduction.

After completion of the chemical sensitization, various compounds may be incorporated in the silver halide grains in order to prevent the occurrence of fcg during the manufacture, storage or development of the photographic material or to stabilize its photographir: properties. Examples of the compounds added for attaining such purposes include azoles such as benzothiazolium salt, nitroindazoles, nitrobenzimidazoles, chlorobenzimidazoles, bromobenzimidazoles, mercaprothiazoles, mercaptobenzimidazoles, aminotriazoles, benzotriazoles, nitrobenzotriazoles, and mercaptotetrazoles (particularly -phenyl-5-mercaptotetrazole); mercaptopyrimidines; mercaptotriazines; thioketo compounds such as oxazolinethione; as well as many other known anti-foggants or stabilizers such as benzenethiosulfinic acid, benzenesulfinic acid, benzenesulfonamide, hydroquinone derivatives, aminophenol derivatives, gallic acid derivatives, and ascorbic acid derivatives. These compounds are preferably added during the chemical sensitization or before coating the emulsion onto a support.

Gelatin and other various hydrophilic colloids may be used as the binder for the silver halide emulsion. Not only gelatin per se but also gelatin derivatives may be employed. Illustrative gelatin derivatives include the reaction products of gelatin with acid anhydrides, isocyanates and with compounds having an active halogen atom. Examples of the acid anhydrides to be reacted with gelatin include maleic anhydride, phthalic anhydride, benzoic anhydride, acetic anhydride, isanic anhydride and succinic anhydride. Examples of the isocyanate compounds include phenyl isocyanate, p-bromophenyl isocyanate, p-chlorophenyl isocyanate, p-tolyl isocyanate, p-nitrophenyl isocyanate and naphtyl isocyanate. Examples of the compounds having an active halogen atom include benzenesulfonyl chloride, p-methoxybenzenesulfonyl chloride, p-phenoxybenzenesulfonyl chloride, p-bromobenzenesulfonyl chloride, p-toluenesulfonyl chloride, m-nitrobenzenesulfonyl chloride, m-sulfobenzoyl dichloride, naphthalene-$\beta$-sulfonyl chloride, p-chlorobenzenesulfonyl chloride, 3-nitro-4-aminobenzenesulfonyl chloride, 2-carboxy-4-bromobenzenesulfonyl chloride, m-carboxybenzenesulfonyl chloride, 2-amino-5-methylbenzenesulfonyl chloride, phthalyl chloride, pnitrobenzoyl chloride, benzoyl chloride, ethyl chlorocarbonate and fluoyl chloride.

In addition to the gelatin derivatives described above and conventional photographic gelatin, various other colloids may be used for preparing silver halide emulsions; they include colloidal albumin, agar, gum arabic, dextrin, alginic acid, cellulose derivaties such as cellulose acetate hydrolyzed to an acetyl content of 19–26 %, polyacrylamide, imidized polyacrylamide, casein, vinyl alcohol polymers containing a urethane carboxylate group or a cyanoacetyl group such as vinyl alcohol-vinyl cyanoacetate copolymer, polyvinyl alcohol-polyvinyl pyrrolidone, hydrolyzed polyvinyl acetate, polymers prepared by polymerizing protein or saturated acrylated protein with monomers having a vinyl group, polyvinyl pyridine, polyvinyl amine, polyaminoethyl methacrylate and polyethyleneimine.

The silver halide emulsion in accordance with the present invention may further contain a variety of known surfactants as coating aids, antistats or as agents to provide better slip properties, assist in dispersion, prevent blocking or to provide improved photographic properties (e.g. accelerated development, hard tone and sensitization). Usable surfactants are shown in U.S. Pat. Nos. 2,240,472, 2,381,766, 3,158,414, 3,210,191, 3,294,540, 3,507,660, British patent Nos. 1,012,495, 1,022,878, 1,179,290, 1,198,450, U.S. Pat. Nos. 2,739,891, 2,823,123, 1,179,290, 1,198,450, 2,739,891, 2,823,123, 3,068,101, 3,415,649, 3,666,478, 3,756,828, British patent Nos. 1,397,218, 3,113,816, 3,411,413, 3,473,174, 3,345,974, 3,726,683, 3,483,368, Belgian patent No. 731,126, British patent Nos. 1,138,514, 1,159,825, 1,374,780, U.S. Pat. Nos. 2,271,623, 2,288,226, 2,944,900, 3,235,919, 3,671,247, 3,772,021, 3,589,906, 3,666,478, 3,754,924, German patent application (OLS) No. 1,961,683, Unexamined Published Japanese patent application Nos. 50-117414, 50-59025, and Japanese patent publication Nos. 40-378, 40-379, and 43-13822. Examples of the surfactants that can be used include nonionic surfactants such as saponins (steroids), alkylene oxide derivatives (e.g. polyethylene glycol, polyethylele glycol/polypropylene glycol condensate, polyethylene glycol alkyl or alkylarylether polyethylene glycol esters, polyethylene glycol sorbitan esters, polyalkylene glycol alkylamines or amides, and silicone polyethylene oxide adducts), glycidol derivatives (e.g. alkenylsuccinate polyglyceride and alkylphenol polyglyceride), aliphatic acid esters of polyols, alkyl esters of sugars, as well as sugar urethanes and ethers; anionic surfacta.nts containing an acidic group (e.g. carboxy, sulfo, phospho, sulfate ester or phosphate ester group) such as triterpenoid saponins, alkyl carboxylates, alkylbenzene sulfonates, alkylnaphthalene sulfonates, alkyl sulfate esters, alkyl phosphate esters, N-acyl-N-alkyltaurines, sulfosuccinate esters, and sulfoalkyl polyoxyethylenealkyl phenyl ethers and polyoxyethylenealkyl phosphate esters; amphoteric surfactants such as amino acids, aminoalkyl sulfonic acids, aminoalkyl sulfate or phosphate esters, alkylbetaines, amineimides and amineoxides; and cationic surfactants such as heterocyclic quaternary ammonium salts, and aliphatic or heterocyclic sulfonium or sulfonium salts (e.g. alkylamine salts, aliphatic or aromatic quaternary ammonium salts, pyridium and imidazolium).

In addition to the surfactants mentioned above, the silver halide emulsion in accordance with the present invention may contain development accelerators such as imidazoles, thioethers and selenoethers of the type described in German patent application (OLS) Nos. 2,002,871, 2,445,611, 2,360,878, and British patent No. 1,352,196.

The silver-halide emulsion may be formulated in a color photographic material by any of the conventional techniques, such as by combining green-, red- and blue-sensitive silver halide emulsions in accordance with the present invention with magenta, cyan and yellow couplers, respectively. Non-diffusible couplers having a hydrophobic 'ballast' group in the molecule are preferably used. The couplers used may be four- or two-equivalent with respect to the silver ion. Colored couplers capable of color correction, or DIR couplers that release development inhibitors as development proceeds may also be used. Also usable are couplers that yield colorless products as a result of coupling reaction.

Known open-chain ketomethylele compounds may be used as yellow color-forming couplers. Advantageous examples are benzoyl acetanilde and pivaloyl acetanilide compounds. Specific examples of the usable yellow color-providing couplers are described in U.S. Pat. Nos. 2,875,057, 3,265,506, 3,408,194, 3,551,155, 3,582,322, 3,725,072, 3,891,445, German patent No. 1,547,868, German patent application (OLS) Nos. 2,213,461, 2,219,917, 2,261,361, 2,414,006 and 2,263,875.

Usable magenta color-forming couplers are pyrazolcne compounds, indazolone compounds and cyanoacetyl compounds. Pyrazolone compounds are particularly advantageous. Specific examples of the usable magenta color-providing couplers are described in U.S. Pat. Nos. 2,600,788, 2,983,608, 3,062,653, 3,127,269, 3,311,476, 3,419,391, 3,519,429, 3,558,319, 3,582,322, 3,615,506, 3,834,908, 3,891,445, German patent No. 1,810,464, German patent application Nos. 2,408,665, 2,417,945, 2,418,959, 2,424,467, and Japanese patent publication No. 40-6031.

Usable cyan color-forming couplers are phenolic compounds and naphtholic compounds. Specific examples are described in U.S. Pat. Nos. 2,639,929, 2,434,272, 2,474,293, 2,521,908, 2,895,826, 3,034,892, 3,311,476, 3,458,315, 3,476,563, 3,583,971, 3,591,383, 3,767,411, German patent application (OLS) Nos. 2,414,830, 2,454,329, and Unexamined Published Japanese patent application No. 48-59838.

Usable colored couplers are described in U.S. Pat. Nos. 3,476,560, 2,521,908, 3,034,892, Japanese patent publication Nos. 44-2016, 38-22335, 42-11304, 44-32461, Japanese patent application Nos. 49-98469, 50-118029 and German patent application (OLS) No. 2,418,959.

Usable DIR couplers are described in U.S. Pat. Nos. 3,227,554, 3,617,291, 3,701,783, 3,790,384, 3,632,345, German patent application (OLS) Nos. 2,414,006, 2,454,301, 2,454,329, British patent No. 953,454, Unexamined Published Japanese patent application No. 57-154234, Japanese patent publication No. 48-28690, Unexamined Published Japanese patent application Nos. 54-145135, 57-151944, 52-82424, U.S. Pat. Nos. 2,327,554, 3,958,993, and Unexamined Published Japanese patent application No. 54-145135.

In addition to the DIR couplers, other compounds that are capable of releasing development inhibitors as development proceeds may be incorporated in the photographic material. Such compounds are described in U.S. Pat. Nos. 3,297,445, 3,379,529 and German patent application (OLS) No. 2,417,914. Also usable are the couplers described in Unexamined Published Japanese patent application Nos. 55-85549, 57-94752, 56-65134, 56-135841, 54-130716, 56-133734, 56-135841, U.S. Pat. No. 4,310,518, British patent No. 2,083,640, Research Disclosure No. 18360 (1979), No. 14850 (1980), No. 19033 (1980), No. 19146 (1980), No. 20525 (1981) and No. 21728 (1982).

Two or more of the couplers listed above may be incorporated in the same layer. Alternatively, the same couplers may be incorporated in two or more different layers.

The couplers may be incorporated in silver halide emulsion layers by any known method such as the one described in U.S. Pat. No. 2,322,027; i.e., the couplers are dissolved in high-boiling organic solvents such as alkyl esters of phthalic acid (e.g. dibutyl phthalate and dioctyl phthalate), phosphate esters (e.g. diphenyl phosphate, triphenyl phosphate, tricresyl phosphate and dioctylbutyl phosphate), citric acid esters (e.g. tributyl acetylcitrate), benzoic acid esters (e.g. octyl benzoate) and alkylamides (e.g. diethyl laurylamide), or in low-boiling (ca. 30°-150° C.) organic solvents such as lower alkyl acetates (e.g. ethyl acetate and butyl acetate), ethyl propionate, secondary butyl alcohol, methyl isobutyl ketone, $\beta$-methoxyethyl acetate and methyl cellosolve acetate. The resulting solution is then dispersed in a hydrophilic colloid. The high-boiling organic solvents may be used in admixture with the low-boiling solvents.

Couplers having acidic groups such as carboxylate or sulfonate groups are introduced into a hydrophilic colloid in the form of an aqueous alkaline solution.

The couplers shown above are used generally in amounts ranging from $2\times10^{-3}$ to $5\times10^{-1}$ mole, preferably $1\times10^{-2}$ to $5\times10^{-1}$ mole, per mole of silver in a silver halide emulsion layer.

The photographic material using the emulsion prepared in accordance with the present invention may contain hydroquinone derivatives, aminophenol derivatives, gallic acid derivatives, ascorbic acid derivatives as agent to prevent the occurrence of color fog. Specific examples of the anti-fog agents are found in U.S. Pat. Nos. 2,360,290, 2,336,327, 2,403,721, 2,418,613, 2,675,314, 2,701,197, 2,704,713, 2,728,659, 2,732,300, 2,735,765, Unexamined Published Japanese patent application Nos. 50-92988, 50-92989, 50-93928, 50-110337, and Japanese patent publication No. 50-23813.

Effective antistats are diacetyl cellulose, styrene-perfluoroalkyllithium maleate copolymers, as well as alkali salts of the reaction product of styrene-maleic anhydride copolymer with p-aminobenzenesulfonic acid. Suitable matting agents include poly(methyl methacrylate), polystyrene and alkali-soluble polymers. Colloidal silicon oxide is also usable as a matting agent. Latices may be added to provide coatings having improved properties, and suitable latices include copolymers of acrylate or vinyl esters and other ethylenically unsaturated monomers. Illustrative gelatin plasticizers are glycerin and glycolic compounds. Exemplary thickeners are styrenesodium maleate copolymer and alkylvinyl ether-maleic acid copolymers.

The photographic material using the thus prepared silver halide emulsion may be coated onto a variety of supports such as baryta paper, polyethylene-coated paper, synthetic polypropylene paper, glass, paper, cellulose acetate, cellulose nitrate, polyvinyl acetal, polypropylene, polyesters such as poly(ethylene terephthalate) and polystyrene. A suitable support should be selected depending upon the specific use of the photographic material. The supports may be subbed as required.

The photographic material using the silver halide emulsion layer prepared in accordance with the present invention is exposed and subsequently processed by any of the known photographic techniques. The black-and-white developers are alkali solutions containing hydroxybenzenes, aminophenol or aminobenzenes as the color developing agent. Other components of the black-and-white developer are alkali metal sulfites, carbonates, bisulfites, bromides and iodides. Color photographic materials prepared in accordance with the present invention may be developed by commonly used color development techniques. In the color reversal method, the material is first developed with a black negative developer, then given exposure to white light or treated in a bath containing an anti-foggant, and finally developed with an alkali solution containing a color developing agent. Any of the known processing schemes may be employed; one scheme comprises color development, bleach-fixing, and if necessary, washing and stabilization. Alternatively, the color development may be followed by separate bleaching and fixing steps.

The silver halide emulsion prepared in accordance with the present invention has an extremely high photographic sensitivity, exhibits improved properties upon short exposure to intense light, and suffers from less fog, so it may be effectively used in a variety of photographic materials such as black-and-white films, X-ray films, color films, infrared films, microfilms, as well as the photographic materials to be processed by the silver dye bleach process, reversal process and the diffusion transfer process.

The following examples are provided for further illustration of the claimed process of the present invention but should not be construed as limiting.

EXAMPLE 1

A seed emulsion comprising monodisperse, spherical seed grains of silver iodobromide (1.4 mol % AgI) was prepared in accordance with the present invention using solutions having the following compositions.

| | |
|---|---|
| Solution A1 | |
| Ossein gelatin | 50 g |
| Potassium bromide (KBr) | 460 g |
| Potassium iodide (KI) | 8 g |
| Water | 2,400 ml |
| Solution B1 | |
| Silver nitrate | 300 g |
| Water to make | 2,000 ml |
| Solution B2 | |
| Silver nitrate | 300 g |
| Ammonia water | EQ.* |
| Water to make | 1,000 ml |

*Sufficient amount to be dissolved as $[Ag(NH_3)_2]^+$.

To solution A1 under agitation at 40° C., solution B1 was added over a period of 20 seconds, producing an emulsion comprising polydisperse, multiply twinned nuclei. The pBr of solution A1 was −0.19 at the time the addition of solution B1 was commenced, and was 0.35 at the time said addition was completed. And, during said addition, the pBr of solution A1 increased in succession. Solution B2 was then added over a period of 20 seconds, and the mixture was ripened for 1 minute. During the ripening, the concentration of bromide ions was held at $6.0\times10^{-2}$ mole/L, the ammonia concentration was controlled at 0.63 mole/L and the pH maintained at 11.0. The ripening was arrested by adding acetic acid to give a pH of 6.0. The mixture was desalted and washed with water by a conventional method, producing an emulsion comprising seed grains (this emulsion is hereunder referred to as Sem - 1).

Observation with an electron microscope showed that Sem - 1 comprised monodisperse spherical grains with an average size of 0.28 μm and a size distribution of 23%.

EXAMPLE 2

A seed emulsion comprising monodisperse, spherical seed grains of silver iodobromide (0.5 mol % AgI) was prepared in accordance with the present invention by repeating the procedures of Example 1 except that the amount of potassium iodide in solution A1 was changed to 2.9 g. The resulting emulsion was referred to as Sem - 2. Electron microscopic observation showed that Sem - 2 comprised monodisperse spherical grains with an average size of 0.32 μm and a size distribution of 25%.

COMPARATIVE EXAMPLE 1

Comparative seed emulsion (Sem - 3) comprising polydisperse silver iodobromide (8 mol % AgI) twinned grains with (111) planes was prepared by using the method of ripening polydisperse multiply twinned nuclei described in Example 1. The preparation techniques were the same as in Example 1 except that the amount of potassium iodide in solution A1 was increased to 46.9 g.

Electron microscopic observation showed that Sem - 3 comprized polydisperse twinned grains with (111) faces that had an average size of 0.21 um and a size distribution of 33%.

EXAMPLE 3

The seed grains in Sem - 1 and Sem - 2 were grown under the conditions described in Table 1 below, so as to prepare emulsions (Em - 1 and Em - 2) comprising monodisperse twinned crystals in accordance with the present invention.

TABLE 1

| Solution | | Emulsion Em - 1 | Emulsion Em - 2 |
|---|---|---|---|
| A1 | ossein gelatin | 14.2 g | 14.2 g |
| | KBr | 19.2 g | 19.2 g |
| | 56% acetic acid | 14.0 ml | 14.0 ml |
| | 28% aq. ammonia | 23.3 ml | 23.3 ml |
| | water | 1530 ml | 1530 ml |
| | Seed emulsion | | |
| | Sem - 1 | equivalent to 0.083 mol | — |
| | Sem - 2 | — | equivalent to 0.123 mol |
| B1 | silver nitrate | 256 g | 249 g |
| | 28% aq. ammonia | EQ. | EQ. |
| | water to make | 717 ml | 698 ml |
| C1 | ossein gelatin | 14.3 g | 14.0 g |
| | KBr | 175.7 g | 171 g |
| | KI | 5.0 g | 4.9 g |
| | water to make | 717 ml | 698 ml |

To solution A1 being agitated at 40° C., either seed emulsion Sem - 1 or Sem - 2 was added. Thereafter, solutions B1 and C1 were added by the double-jet method at the varying speeds shown in Table 2. Throughout the addition, the pBr was maintained at 1.1 and the pH was continuously changed from the initial 9.0 to the final 8.0.

TABLE 2

| Em - 1 Time (min) | Em - 1 Flow rate (ml/min) | Em - 2 Time (min) | Em - 2 Flow rate (ml/min) |
|---|---|---|---|
| 0.00 | 2.33 | 0.00 | 2.96 |
| 11.69 | 6.84 | 10.02 | 7.50 |
| 17.63 | 10.3 | 15.54 | 10.9 |
| 21.92 | 13.2 | 19.65 | 13.7 |
| 25.43 | 15.6 | 23.03 | 16.0 |
| 28.47 | 17.5 | 26.01 | 17.8 |
| 31.24 | 18.9 | 28.73 | 19.2 |
| 33.83 | 19.9 | 31.30 | 20.1 |
| 36.81 | 20.7 | 33.77 | 20.6 |
| 40.19 | 21.2 | 36.68 | 20.9 |

Immediately after completion of the addition of solution B1 and C1, the pH of the mother liquor was adjusted to 6.0 with acetic acid, followed by desalting and washing with water by a conventional method. Electron microscopic observation of the resulting two emulsions, Em - 1 and Em - 2, revealed the following. Nearly 100% of the grains in Em - 1 were twins bound by (111) planes and about 82% of such twins was tabular. The size distribution of the grains was 13% and their average size was found to be 0.92 μm by measurement of the diameter of the circumcircle. It was therefore clear that Em - 1 comprised of grains with high monodispersity. Nearly 100% of the grains in Em - 2 were also twins bound by (111) surfaces and about 84% of such twins were tabular. The size distribution of the grains was 12% and their average size was found to be 0.85 μm in terms of the diameter of circumcircle. Em - 2 was also comprised of highly monodisperse grains.

COMPARATIVE EXAMPLE 2

The seed grains in Sem - 3 were grown under the conditions described in Table 3 below, so as to prepare comparative emulsion Em - 3.

TABLE 3

| Solution | | Emulsion Em - 3 |
|---|---|---|
| A1 | ossein gelatin | 15.2 g |
| | KBr | 19.2 g |
| | 56% acetic acid | 14.0 ml |
| | 28% aq. ammonia | 23.3 ml |
| | water | 1520 ml |
| | Seed emulsion Sem-3 | equivalent to 0.036 mol |
| B1 | silver nitrate | 264 g |
| | 28% aq. ammonia | EQ. |
| | water to make | 740 ml |
| C1 | ossein gelatin | 14.8 g |
| | KBr | 181 g |
| | KI | 5.2 g |
| | water to make | 740 ml |

To solutino A1 being agitated at 40° C., one of the three seed emulsions was added. Thereafter, solutions B1 and C1 were added by the double-jet method at the varying speeds shown in Table 4. Throughout the addition, the pBr was held at 1.1 and the pH was continuously changed from the initial 9.0 to the final 8.0.

TABLE 4

| Em - 3 Time (min) | Em - 3 Flow rate (ml/min) |
|---|---|
| 0.00 | 1.40 |
| 15.27 | 6.01 |
| 21.82 | 9.56 |
| 26.39 | 12.6 |
| 30.05 | 15.0 |
| 33.20 | 17.1 |
| 36.02 | 18.6 |
| 38.65 | 19.7 |
| 42.14 | 20.7 |
| 45.51 | 21.1 |

Immediately after the completion of the addition of B1 and C1, the pH of the mother liquor was adjusted to 6.0 with acetic acid, followed by desalting and washing with water by a conventional method. Electron microscopic observation of the resulting emulsion, Em - 3 reavealed the following: nearly 100% of the grains in the emulsion were twinned crystals bound by (111) planes but their size distributions were considerably broader than in the emulsions prepared in accordance with the present invention: 28% for the grains (av. size=0.79 μm).

EXAMPLE 4

A portion was divided from each of emulsion samples Em - 1 to Em - 3 so that the content of silver halide in that portion was equivalent to 0.35 mole. After chemical sensitization with ammonium thiocyanate, sodium thiosulfate and chloroauric acid, each portion was spectrally sensitized with 20 mg each of three green sensitizing dyes, anhydro-5,5'-dichloro-9-ethyl-3,3'-di-(3-sulfopropyl)oxacarbocyaninhydroxide, anhydro-5,5'-diphenyl-9-ethyl-3,3'-di-(3-sulfopropyl)oxacarbocyanine, and anhydro-9-ethyl-3,3'-di-(3-sulfopropyl)-5,6,5,6'-dibenzooxacarbocyaninhydroxide. Thereafter, 4-hydroxy-6-methyl-1,3,3a,7-tetrazaindene and 5-phenyl-1-mercaptotetrazole were added. Subsequently, 1,200 ml of a dispersion (m - 1, see below for its composition), saponin and 1,2-bisvinylsulfonylethane were added, and each mixture was coated onto a cellulose triacetate base to give a silver deposit of 15 mg/dm$^2$. The web was dried to provide a sample having a stable coat. By repeating these procedures, sample Nos. 1 to 3 were prepared using emulsions Em - 1 to Em - 3.

Dispersion (M - 1)

A magenta coupler, 1-(2,4,6-trichlorophenyl)-3-[3-(2,4-di-tert-amylphenoxyacetamido)-benzamido]-5-pyrazolone present in an amount of $8\times10^{-2}$ mole per mole of silver halide, and a DIR compound, 2-(1-phenyl-5-tetrazolylthio)-4-octadecylsuccinimido-1-indanone present in an amount of 0.28 mole per mole of silver halide were mixed with a high-boiling organic solvent, tricresyl phosphate of the same weight as the coupler. To the mixture, ethyl acetate was added and heated at 60° C. to produce a complete solution. The resulting solution was mixed with 50 ml of a 10% aqueous solution of Alkanol B (the trade mark of du Pont for alkylnaphthalene sulfonate) and 700ml of a 10% aqueous gelatin solution, and a uniform dispersion was obtained by agitating the mixture in a colloid mill.

Sample Nos. 1 to 3 were exposed to white light in a sensitometer (Model KS - 1 of Konishiroku Photo Industry Co., Ltd.) in accordance with the JIS and processed by the following scheme.

| | Steps (37.8° C.) | Time |
|---|---|---|
| 1. | Color development | 3 min and 15 sec |
| 2. | Bleaching | 6 min and 30 sec |
| 3. | Washing | 3 min and 15 sec |
| 4. | Fixing | 6 min and 30 sec |
| 5. | Washing | 3 min and 15 sec |
| 6. | Stabilizing | 1 min and 30 sec |
| 7. | Drying | |

| | |
|---|---|
| Color developer formulation | |
| 4-Amino-3-methyl-N—ethyl-N—(β-hydroxyethyl)-aniline sulfate | 4.8 g |
| Anhydrous sodium sulfite | 0.14 g |
| Hydroxylamine hemisulfate | 1.98 g |
| Sulfuric acid | 0.74 g |
| Anhydrous potassium carbonate | 28.85 g |
| Anhydrous potassium hydrogen carbonate | 3.46 g |
| Anhydrous potassium sulfite | 5.10 g |
| Potassium bromide | 1.16 g |
| Sodium chloride | 0.14 g |
| Nitrilotriacetic acid trisodium salt (monohydrate) | 1.20 g |
| Potassium hydroxide | 1.48 g |
| Water to make | 1,000 ml |
| Bleaching solution formulation | |
| Ethylenediaminetetraacetic acid iron ammonium salt | 100.0 g |
| Ethylenediaminetetraacetic acid diammonium salt | 10.0 g |
| Ammonium bromide | 150.0 g |
| Glacial acetic acid | 10.0 ml |
| Water to make | 1000 ml |
| pH adjusted to 6.0 with ammonia water. | |
| Fixing solution formulation | |
| Ammonium thiosulfate | 175.0 g |
| Anhydrous sodium sulfite | 8.6 g |
| Sodium metasulfite | 2.3 g |
| Water to make | 1,000 ml |
| pH adjusted to 6.0 with acetic acid. | |
| Stabilizer formulation | |
| Formalin | 1.5 ml |
| Konidax (product of Konishiroku Photo Industry Co., Ltd.) | 7.5 ml |
| Water to make | 1.000 ml. |

The processed samples were subjected to sensitometric analysis and the results are shown in Table 5. The sensitivity is expressed by the relative value of the reciprocal of the exposure giving a density of (fog +0.1) after development, with the value for sample No. 2 taken as 100. The "granularity" is expressed by the relative value of the standard deviation times 1000 of the variations that occurred whtn a dye image with a density of (fog +0.7) was scanned with a microdensitometer (scanning aperture=25 μm$^{\phi}$), with the value for a control being taken as 100.

TABLE 5

| Sample No. | Em No. | Sensitivity | Fog | Gamma | RMS granularity | Percent fraction of dead grains |
|---|---|---|---|---|---|---|
| 1 | Em-1 | 135 | +0.18 | 0.67 | 20 | 8 |
| 2 | Em-2 | 100 | +0.17 | 0.66 | 21 | 12 |
| 3 | Em-3 | 83 | +0.18 | 0.65 | 30 | 21 |

The above data show that Emulsion sample Nos. 1 and 2 containing the monodisperse silver halide grains prepared by the process of the present invention and higher sensitivities and better granularities than comparative sample No. 3. Samples Nos. 1 and 2 also had fewer dead grains, indicating enhanced utilization of silver halide grains in the development.

EXAMPLE 5

An emulsion comprissing the polydisperse, multiply twinned nuclei of silver iodobromide (0.5 mol % AgI) was prepared using the five solutions indicated below.

| | |
|---|---|
| Solution A | |
| Ossein gelatin | 25 g |
| KBr | 50 g |
| Distilled water | 5,000 ml |
| Solution B | |
| Ossein gelatin | 17 g |
| KBr | 625 g |
| KI | 4.15 g |
| Distilled water to make | 1,665 ml |
| Solution C | |
| $AgNO_3$ | 850 g |
| Distilled water to make | 1,665 ml |
| Solution D | |
| KBr | 197 g |
| Distilled water | 400 ml |
| Solution E | |
| 28% aq. ammonia | 330 ml |
| Solution F | |
| 56% acetic acid | 560 ml. |

To solution a being agitated at 40° C., solutions B and C were added by the double-jet method. The flow rate was gradually increased from the initial 35 ml/min to the final 80 ml/min. During the double-jet addition, the pBr was held at 1.1. The addition was completed in 33 minutes. Thereafter, the mother liquor was desalted and washed with water by a conventional method. Electron microscopic observation showed that 60% of the grains in the resulting emulsion were multiply twinned crystals bound by (111) faces; the grains had an average size of 0.25 μm and a size distribution of 35%.

The emulsion comprising such polydisperse grains was divided into two portions, which were ripened under the conditions shown in Table 6. The size distributions and the crystallographic morphologies of the resulting seed grains are summarized in Table 6.

TABLE 6

| | Ripening conditions | | | | | |
|---|---|---|---|---|---|---|
| | Solvents | | | | | |
| Seed emulsion | Ammonia mol/l | Tetramethylthiourea mol/l | KBr molar conc. | pH | Time (min.) | Temperature |
| Sem-4 (in accordance with the present invention) | 0.80 | — | 0.52 | 10.9 | 1 | *40 |
| Sem-5 (in accordance with the present invention | — | $0.25 \times 10^{-3}$ | 1.5 | 8.0 | 5 | **60 |

Note: Ripened crystal features:
*Size distribution 23%
Morphology Spheres
**Size distribution 24%
Morphology Spheres As the above data show, an emulsion comprising monodisperse spherical seed grains can be obtained.

What is claimed is:

1. A process for producing a silver halide photographic emulsion by supplying a solution of water soluble silver salt and a solution of water soluble halide in the presence of a protective colloid, said process comprising, in sequence, the steps of:

(a) forming silver halide nuclear grains with a silver iodide content of 0 to 5 percent in a mother liquor, the pBr of the mother liquor being maintained at between 2.0 and −0.7 for at least the initial half of the time necessary to form said nuclear grains, (b) forming monodispersed, substantially spherical, silver halide seed grains by ripening the nuclear grains formed in (a), in a mother liquor containing a silver halide in an amount of $10^{-4}$ to 5 moles per liter of mother liquor and, (c) increasing the size of the seed grains by at least one method taken from the group consisting of (1) the addition of a solution of a water soluble silver salt and a solution of a water soluble halide and (2) the addition of fine silver halide grains.

2. A process for producing a silver halide photographic emulsion according to claim 1, wherein the seed grains are ripened for a period of 30 seconds to 20 minutes.

3. A process for producing a silver halide photographic emulsion according to claim 1, wherein said silver halide solvent is a combination of a water-soluble bromide and any other solvent.

4. A process for producing a silver halide photographic emulsion according to claim 3, wherein said silver halide solvent is a combination of potassium bromide and ammonia.

5. The process of claim 1 wherein the mother liquor of step (b) is maintained at a temperature in the range of 30°-60° C.

* * * * *